United States Patent [19]

Pomeroy

[11] Patent Number: 4,521,009

[45] Date of Patent: Jun. 4, 1985

[54] PORTABLE EXERCISE DEVICE

[76] Inventor: Gary G. Pomeroy, 117 Glenside Tr., Sparta, N.J. 07871

[21] Appl. No.: 408,168

[22] Filed: Aug. 16, 1982

[51] Int. Cl.[3] ..... A63B 23/04

[52] U.S. Cl. ..... 272/73; 272/132; 272/DIG. 4

[58] Field of Search ..... 272/73, 132; D21/194

[56] References Cited

U.S. PATENT DOCUMENTS

| | | | |
|---|---|---|---|
| 3,226,115 | 12/1965 | Underhill | 272/73 X |
| 3,227,447 | 1/1966 | Baker et al. | 272/73 X |
| 3,259,385 | 7/1966 | Boren | 272/73 |
| 3,968,963 | 7/1976 | Sileo | 272/73 X |
| 4,222,376 | 9/1980 | Praprotnik | 272/73 X |
| 4,225,130 | 9/1980 | Zimmerman | 272/73 |
| 4,390,177 | 6/1983 | Biran et al. | 272/132 |

FOREIGN PATENT DOCUMENTS

| | | | |
|---|---|---|---|
| 1468272 | 12/1966 | France | 272/73 |
| 1210722 | 10/1970 | United Kingdom | 272/73 |

*Primary Examiner*—Robert A. Hafer
*Assistant Examiner*—Arnold W. Kramer
*Attorney, Agent, or Firm*—Laughlin & Markensohn

[57] ABSTRACT

A portable exercise device for use with the user's legs at various locations. The device comprises a curved frame having feet for resting on a surface and handlebars for gripping the device, and a pedal arrangement. The pedal arrangement is adjustable to require different degrees of force to be applied to the pedals while in use.

9 Claims, 7 Drawing Figures

PORTABLE EXERCISE DEVICE

BACKGROUND OF THE INVENTION

In recent years there has been an increasing emphasis on physical fitness. Pedaling against a resistance such as encountered during bicycle riding is a particularly effective mode of physical exercise. In order to enable one to gain the benefits of pedaling without requiring one to go outdoors various stationary bicycle exercising devices are commercially available. Typical of such devices are those disclosed in U.S. Pat. Nos. 3,578,800, issued May 8, 1971; 3,572,699, issued Mar. 30, 1971; and 4,007,927, issued Feb. 15, 1977. These devices function very effectively for physical fitness but have the disadvantage that they are bulky and primarily stationary, which limits the place in which they can be used. Portable exercise devices have been suggested. Typical of such devices are those shown in the following U.S. Patents: No. 4,225,130, issued Sept. 30, 1980 to J. Zimmerman; No. 3,751,033, issued Aug. 7, 1973 to W. Rosenthal. Also such exercise devices for use with conventional chairs are shown in U.S. Pat. No. 3,759,512, issued Sept. 18, 1973, to A. Yount; No. 2,668,709, issued Feb. 9, 1954 to R. Boyko; No. 3,968,963, issued July 13, 1976; and No. 4,222,376, issued Sept. 16, 1980 to L. Praprotnik. Further, a stool type apparatus is shown in U.S. Pat. No. 3,443,664, issued May 13, 1969, to J. Frassanito et al. All of these devices require rigid connection to the chair and are bulky as are many of the conventional static bicycle devices.

One of the greatest problems to overcome in promoting the continuous use of such devices is boredom. In order to obtain the necessary exercise, a considerable length of time has to be spent in one location and day after day. It is apparent therefore that it would be desirable to have a truly portable device which could be moved from place to place easily allowing different environments for its use, thereby allowing substantial reduction in the boredom factor.

SUMMARY OF THE INVENTION

This invention relates to a portable exercise device, and more particularly to such a device of the bicycle pedal type and which enables the user to regulate the exertion and frictional resistance and thus the amount of tension opposing the muscular effort exerted by the user.

It is an object of the invention to provide a portable exercising device that can be easily moved from place to place and stored in a relatively small area. It is another object of the invention to provide such a device which is light-weight and stable in use. It is a further object of the invention to provide a portable exercise device which can be adjusted to vary the amount of force required to use the device. It is still a further object of the invention to provide such a device which is small and quiet in operation. Other objects and the advantages of the invention will appear from the following description.

In accordance with the invention a portable exercise device is provided comprising a light-weight rod or tube member curving or bent to define a plane and serving as a frame; a stand at one end of said frame providing supporting feet upon a line perpendicular to the plane defined by the curved section of said frame, said feet being at opposite side of said plane, a handlebar providing gripping areas or handles at opposite sides of the plane of said frame; an axle mounted on the frame, revolving about an axis perpendicular to said plane; means providing resistance to the revolution of the axle; crank bars or pedals affixed to opposite ends of said axle whereby the axle can be caused to revolve; and adjustment means for adjusting the resistance to rotation of the axle.

DETAILED DESCRIPTION OF THE PREFERRED EMBODIMENTS

Figure 1:
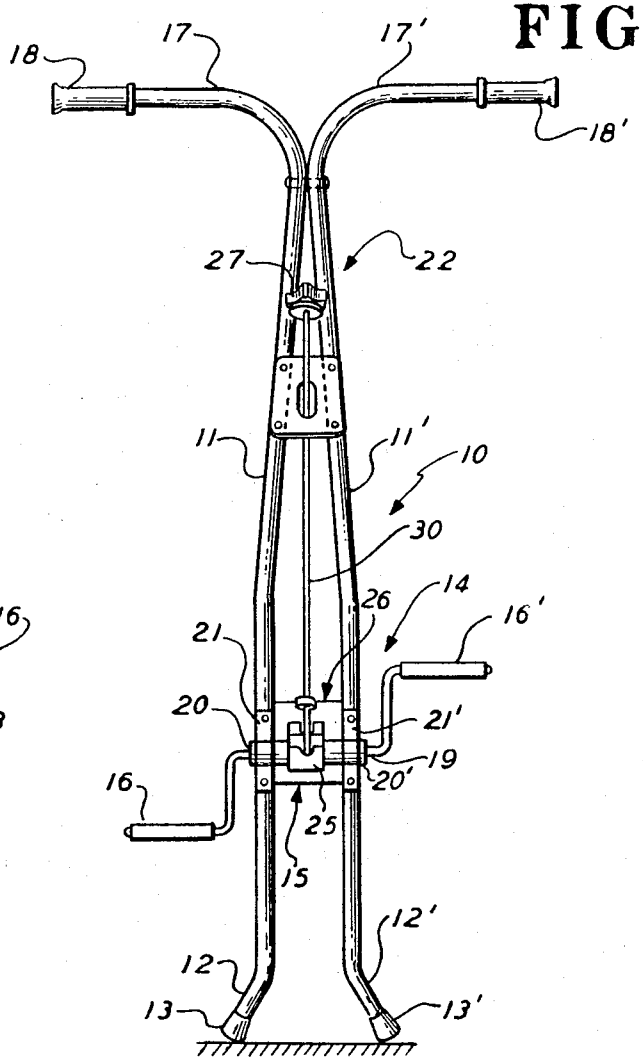
FIG. 1 is a schematic diagram of an embodiment of the portable exercising device of the invention.

Referring to the drawings the illustrative embodiment of the invention comprises a frame component, generally indicated at 10, of light-weight metals such as aluminum or steel tubing. The frame however can be made of other materials such as a box design or molded from plastic. The shape of the frame is one of the essential embodiments of the invention. Tubing frame is bent to provide outwardly flaring legs 12,12'. Each leg is provided with a frictional element 13,13' to prevent sliding when in contact with the floor or other supporting surface. Typical of such friction elements are rubber caps on the end of the tubing or composition bands around the leg elements. The frame extends vertically upward from the floor operating surface to a pedal device, generally indicated at 14, which contains a friction or tension device, generally indicated at 15, for creating various degrees of resistance to the rotation of the pedals 16,16'. The location of the pedal device is sufficiently above the floor to allow the free movement or rotation of the pedals without contacting the floor. The frame then extends in generally curving fashion towards the user, who sits to provide a base of support supplementing the feet of the device, conveniently on a stool or in a chair. The frame terminates in a flare arrangement 17,17' which can be in the form of handles 18,18' for the user to grip the apparatus.

Figure 2:
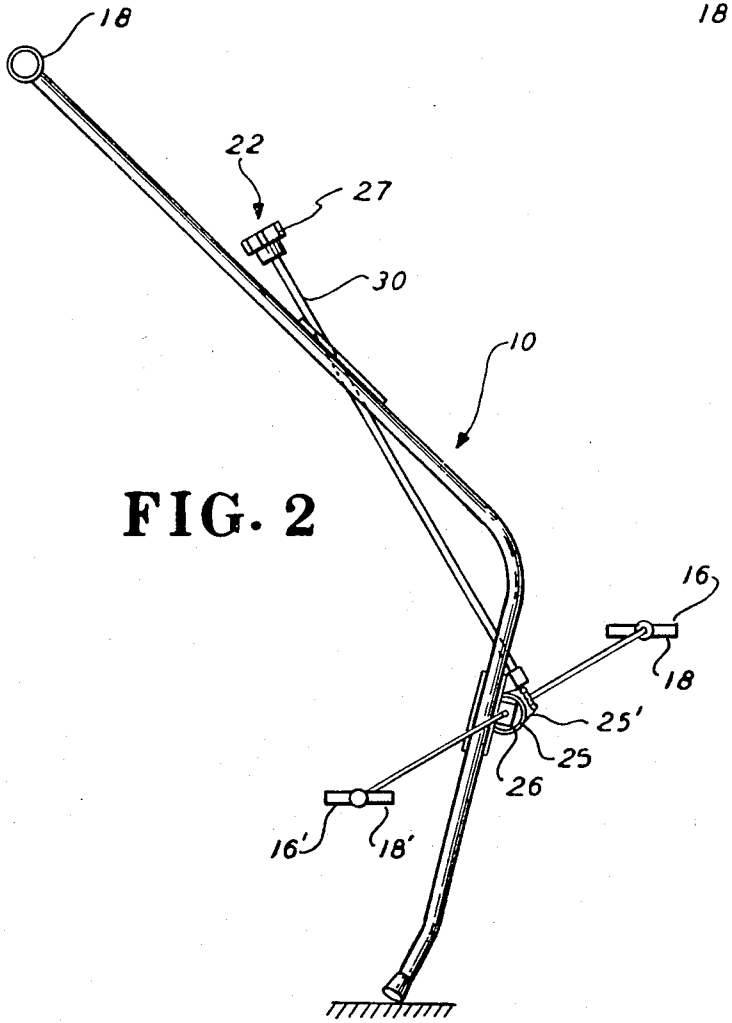
FIG. 2 is a side view of the exercise device shown in FIG. 1.

The frame, in this embodiment of FIGS. 1 and 2, is made of two identical rods or pieces of tubing 11,11' being mirror images of each other. The two rods are spaced apart to allow insertion of the pedal assembly 14.

Figure 7:
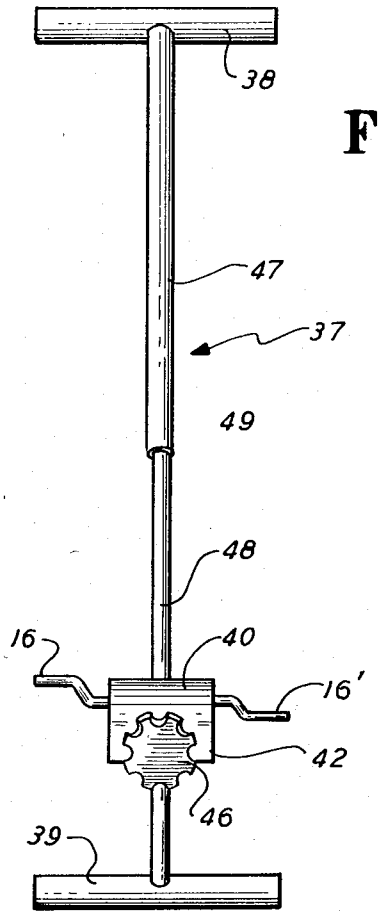
FIG. 7 is a diagrammatic front view of the exercise device of FIG. 6.
Figure 6:
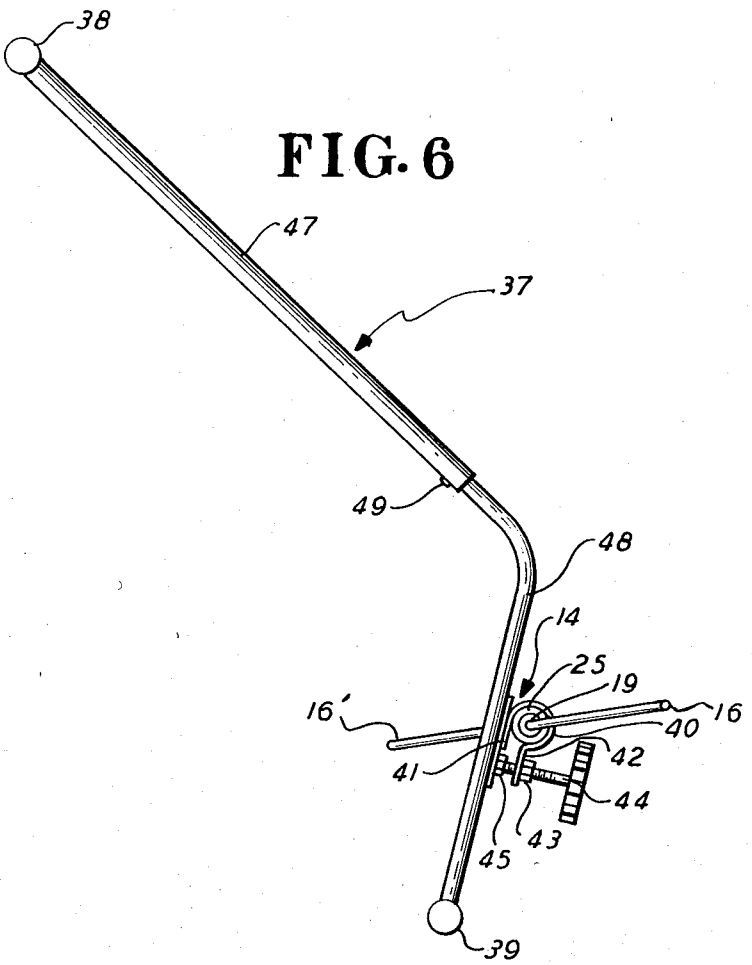
FIG. 6 is a diagrammatic side view of an embodiment of the invention in which a single bent rod provides the frame, another single rod provides the handle, another provides the feet, and a clamp operated by pressure of a set screw provides adjustment for the resistance.

In the embodiment of FIGS. 6 and 7, a single bent rod or tube provides the frame, and a single bar 38 provides the handles and another 39 provides the feet.

In both of the above embodiments the pedals 16,16' are arranged to rotate about the longitudinal axis of an axle 19, perpendicular to the plane defined by the bend of the frames. In the embodiment of FIG. 1, the axle is held on the frame in bearings 20,20' secured to the frame by plates 21,21'.

If desired, the pedals can be provided with stirrups for holding the feet of the user on the pedals.

The means 15 for adjusting resistance to rotation of axle 19 can be of various construction. The means shown in FIG. 1 includes adjusting means, generally indicated at 22, for adjusting the amount of friction applied to the axle 19 so that the user can adjust the desired resistance to provide the amount of physical exertion he desires. The friction adjusting means basically comprises a split sleeve 25 having a frictional material lining 25' such as a fibrous material. The sleeve is mounted in a holder assembly, generally indicated at 26 affixed between the bearings, and partially surrounds the midsection of the axle.

Figure 3:
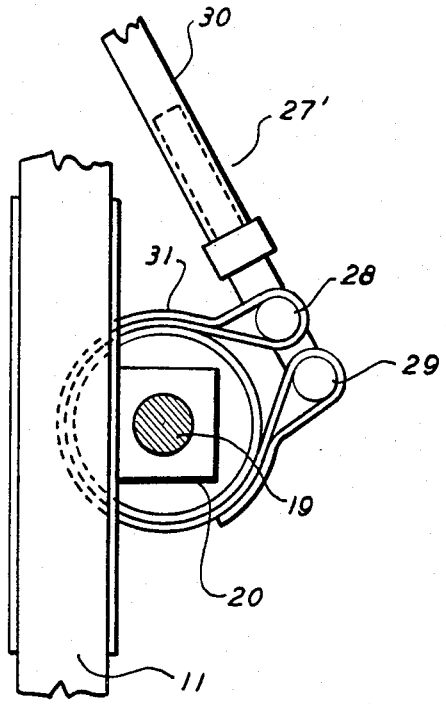
FIG. 3 is an enlarged view of part of the portable exercising device of FIG. 1 showing the means for creating resistance to the rotation of the pedals.

A tension bar 30 is provided for adjusting the force exerted by the sleeve on the axle. The tension bar 30 is mounted on the frame to allow rotation of the bar. At one end of the bar is a knob 27 or the like to allow the user of the apparatus to rotate the bar both clockwise and counterclockwise. The opposite end 27' is provided with a stationary fixed station 28 and an adjustable station 29. The adjustable station moves toward or away from the fixed station as the tension bar is rotated. A metal strip 31 (FIG. 3) is affixed at its respective ends to the stations 28,29 and passes around the axle.

As is appreciated by those skilled in the art, by tightening the tension bar via the rotation of its handle, the stations are brought together. This action squeezes the metal strap 31 more tightly about the periphery of axle 19. Accordingly greater frictional engagement is made between the surface of the axle and the strap, whereupon greater force is necessary to be applied to the pedals to effect rotation of the axle. Conversely, moving the stations apart results in a decreasing of the frictional engagement between the metal strap and the axle so that less force is necessary to be applied to the pedals to rotate the axle.

The friction applying device for applying a force against the rotation of the axle can take a number of other forms. Types of suitable devices are shown in FIGS. 4, 5 and 6.

Figure 4:
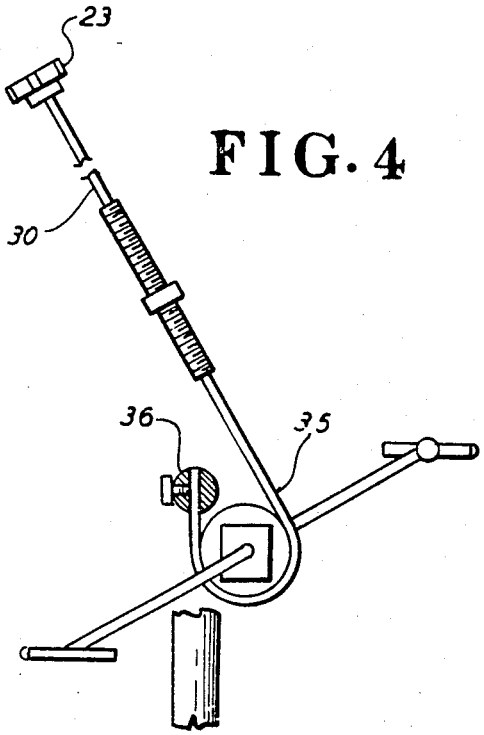
FIG. 4 is another apparatus for applying resistance to the motion of the pedals in the exercising device of the invention.

In FIG. 4, the device for applying frictional force to the axle consists of a strap 35 which passes around a portion of the axle and is affixed at one end 36 to the frame. The strap can be composition material such as that used conventionally in automobile brake linings. Alternatively the strap can be lined with such material. The opposite end of the strap is affixed to the tension bar 30 described hereinabove and operates in similar fashion.

Figure 5:
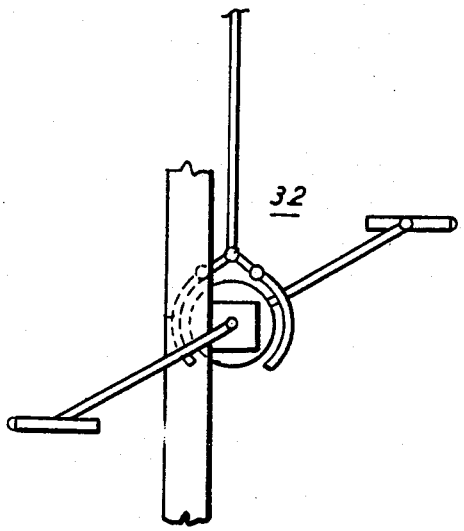
FIG. 5 is another apparatus for applying resistance to the motion of the pedals in the exercising device of the invention.

In the device of FIG. 5, friction is applied to the axle by opposing calipers 32, surrounding the axle. The tension bar 30 is provided with a threaded portion on one end which passes into the calipers. Rotation of the bar clockwise will cause the calipers to close and in the opposite direction to open. Composition material is placed on the inside of the calipers which presses against the axle thereby supplying the necessary frictional force.

In the embodiment of FIGS. 6 and 7 a split sleeve 25 like that above described partially surrounds axle 19 to create frictional resistance to rotation of axle 19. The adjustment of the resistance due to sleeve 25 is accomplished by a resilient clamp 40 fitting around the sleeve. End 41 of clamp 40 is affixed as by brazing or welding to rod 37. End 42 of the clamp is resiliently and adjustably pressed toward end 41, to tighten the clamp around sleeve 25, by the force exerted thereon by collar 43 fixed around screw 44. Screw 44 passes through an opening in end 42 of the clamp and enters a fixed threaded nut 45. The position of collar 43, in and out, is adjusted by turning knob 46 thereby moving screw 44 into or out of threaded nut 45 and moving collar 43 to press end 42 toward end 41 or allow end 42 to move away from end 41, thereby squeezing or loosening sleeve 25 around axle 19. The clamp 40 of FIGS. 6 and 7 can be designed, as shown in FIG. 7, to hold axle 19 in position on frame 37, or bearings as in FIG. 1 can be provided for that purpose.

Suitably the frame of the present exercise device can be constructed to be disassembled into two or more sections. For example as illustrated in FIGS. 6 and 7, the single rod or tube comprising frame 37 can consist of an upper tubular section 47 fitting over a lower tube or rod section 48, with a screw 49 or the like holding the two sections together as a single rod when assembled. If desired, rod 48 can be slidable within tube 47 whereby the length of frame 37 will be adjustable to suit the convenience of the user.

While the invention has been described with reference to its preferred embodiment thereof, it will be appreciated by those of ordinary skill in the art that various changes can be made in the process and apparatus without departing from the basic spirit and scope of the invention.

What is claimed is:

1. An easily portable device for exercising a person's legs or arms comprising a curved frame, said frame having feet on one end for supporting the device on a surface and handles being located on both sides of the plane defined by the curve of the frame, whereby to give the device stability in use when the user is in a sitting position and is grasping the handles, the mid-section of said frame is curved rearwardly in cantilevered fashion from the principal plane defined perpendicular to the handles and feet;

a pedal assembly, said pedal assembly comprising an axle mounted on said frame having a pair of diametrically opposed crank bars affixed on opposite ends of said axle, said crank bars providing pedals for causing said axle to revolve;

means providing resistance to the rotation of said axle including a resilient single piece clamp sleeve fitting around the axle with one end of the sleeve being fixed relative to said frame and the other movable end being resiliently and adjustably pressed toward said fixed end by action of a screw rotating in a threaded nut fixed to the frame.

2. The easily portable device of claim 1 wherein said frame comprises two mirror image tubular rods, longitudinally extending feet and vertically extending handles and said two rods being secured together by said pedal assembly.

3. The easily portable device of claim 1 wherein said means to provide resistance to the rotation of said axle includes a split sleeve within said single piece clamp sleeve and partially surrounding the axle, friction material on the inside of the split sleeve in contact with the axle, and said screw having a knob at one end for rotating screw passing through said single piece clamp sleeve so that when the screw is rotated in one direction the clamp sleeve and split sleeve therein are caused to close and in the opposite direction to open thereby increasing and decreasing the frictional force on said axle.

4. The easily portable device of claim 1 wherein said frame comprises an upper tube fitting over a lower tube or rod to form a single curved tube or rod of adjustable length.

5. The easily portable device of claim 1 wherein the screw is provided with a collar for engaging the movable end of the clamp; and further comprising said fixed nut provided at the frame for supporting the screw such that by rotation of the screw the tension of the clamp around the axle can be adjusted.

6. The easily portable device of claim 5 wherein the fixed end of the clamp continues at the about closest point of the axle relative to the frame in tangential direction parallel to the frame and where the movable end of the clamp is about planar and disposed about parallel to the fixed end and where the movable end joins the circular part of the clamp surrounding the axle at an angle along a line parallel to the axle.

7. The easily portable device of claim 1 wherein the resilient clamp is formed of a piece of flat material.

8. The easily portable device of claim 1 wherein the screw is disposed at the front side of the frame with the rotation axis of the screw being perpendicular to the longitudinal direction of the frame in that area such that the screw can be adjusted from the front side of the frame.

9. The easily portable device of claim 1 further comprising a knob for turning the screw.

* * * * *